United States Patent [19]

Cushing

[11] 4,334,143

[45] Jun. 8, 1982

[54] HEATER PROTECTION ARRANGEMENT FOR A WASHING APPLIANCE

[75] Inventor: Donald S. Cushing, Louisville, Ky.

[73] Assignee: General Electric Company, Louisville, Ky.

[21] Appl. No.: 83,912

[22] Filed: Oct. 11, 1979

[51] Int. Cl.[3] ..... H05B 1/02

[52] U.S. Cl. ..... 219/333; 219/324; 219/492; 134/113; 134/56 D

[58] Field of Search ..... 219/333, 323, 324, 494, 219/492; 236/31; 134/56 D, 57 D, 58 D, 113; 137/387, 400, 409, 399; 340/623, 624

[56] References Cited

U.S. PATENT DOCUMENTS

| | | | |
|---|---|---|---|
| 2,799,848 | 7/1957 | Glantz et al. | 137/409 |
| 3,490,486 | 1/1970 | Cushing | 219/333 |
| 3,539,153 | 10/1970 | Wennerberg et al. | 134/57 D |
| 3,835,880 | 9/1974 | Hoffman et al. | 137/387 |
| 4,069,425 | 1/1978 | Cushing | 134/57 D |
| 4,213,313 | 7/1980 | Kiefe et al. | 134/58 D |

*Primary Examiner*—B. A. Reynolds
*Assistant Examiner*—M. H. Paschall
*Attorney, Agent, or Firm*—Radford M. Reams

[57] ABSTRACT

In a washing appliance, such as a dishwasher, employing a high watt density heater for heating washing liquid in the wash chamber of the appliance, a control circuit which integrates a liquid level sensor employed for positive liquid fill control and heater protection with the sequence controller to prevent damage to the heater in the event of a malfunction of the liquid level sensor which causes the sensor to indicate a full liquid level regardless of the actual liquid level in the wash chamber. The level sensor includes a switch which assumes a reset position when the sensed liquid level is less than a full level and a full position when the sensed liquid level equals the full level. The switch is operative in its reset position to enable liquid fill and prevent heater energization and in its full position to terminate fill and enable heater energization. In a preferred form of the invention, first and second switches controlled by the sequence controller for actuation in a predetermined sequence at the end of the drain cycle are arranged in combination with the level sensor controlled switch. This switch arrangement is operative to prevent continued cyclic operation of the appliance by interrupting energization of the sequence controller timer motor in the event the level sensor controlled switch fails to assume its reset position at the end of the drain cycle.

6 Claims, 3 Drawing Figures

HEATER PROTECTION ARRANGEMENT FOR A WASHING APPLIANCE

BACKGROUND OF THE INVENTION

This invention relates generally to automatic washing appliances such as dishwashers, particularly to dishwashers employing high wattage heaters for heating the dishwashing liquid during certain wash and rinse cycles. More specifically, this invention relates to an improved control system which prevents further cyclical operation of the appliance in the event of a malfunction in which the level sensing means does not reset following a drain cycle during which liquid is removed from the tub. This provides additional protection against undesirable overheating of the liquid, the heater, or the tub which could occur in the event the heater is energized with insufficient liquid in the tub.

Washing appliances employing heater means for heating the washing liquid and employing float-actuated switch means to enable energization of the heater means when the liquid in the chamber exceeds a predetermined level and to prevent energization when the liquid level is below a predetermined level are well known in the art. U.S. Pat. No. 3,846,615-Athey et al and U.S. Pat. No. 3,083,717-Bear are illustrous of such machines.

U.S. Pat. No. 4,068,114-Johnson et al discloses a dishwasher in which a mechanical float is used to provide positive fill control and heater protection. In Johnson et al, an electrically operated solenoid valve initiates the fill operation and a float-actuated mechanical valve terminates fill when the water reaches a preselected maximum level. Timer control of the solenoid valve provides a redundant fill control. After a predetermined period of time has elapsed, the solenoid valve is closed and terminates fill. This prevents overfill in the event of a failure of the mechanical valve. In addition to closing the mechanical fill valve, the float also controls a switch to prevent energization of the heater disposed in the wash chamber when the level of liquid in the wash chamber either fails to reach or drops below a preselected level.

While the arrangements disclosed in this prior art perform their desired protective functions so long as the float mechanism operates properly, little provision is made for a malfunction of the float means. The float mechanism typically is exposed to the interior of the wash chamber. Thus, it is possible for food particles, small bone fragments, toothpicks, or similar items to become lodged in the mechanism so as to interfere with proper operation of the float mechanism. A redundant fill control, as taught by Johnson et al, eventually turns off the water even though the float becomes stuck in the low level or empty position. However, it does not address the problem of the float becoming stuck in the high or full position. When stuck in the full position the float means would prevent liquid fill while enabling heater energization during subsequent cycles. In such an instance the heater means could be energized with insufficient liquid in the wash chamber, possibly resulting in heat damage to the heater or the tub. Even in those instances when a thermostat is provided to control the liquid temperature, its response in the absence of liquid is may be too slow to adequately protect the heater and tub. Thus, it is desirable to provide a control circuit for a washing appliance such as a dishwasher which provides protection against the float mechanism becoming stuck in the high or full position.

It is therefore an object of the present invention to provide a washing appliance control system which prevents continued operation after a drain cycle if the liquid level sensor indicates higher than a predetermined level of liquid in the machine.

It is a further object of the present invention to provide a control system for a washing appliance which automatically determines whether the level sensing means has reset by the end of a drain cycle and prevents the initiation of subsequent operating cycles if the level sensing means has not reset.

It is a further object of the present invention to provide a control system for a washing appliance which includes a timer motor for controlling cyclical operation of the appliance and which incorporates protective switch means to automatically interrupt energization of the timer motor following a drain cycle in the event the float means remains in the full position at the end of the drain cycle.

SUMMARY OF THE INVENTION

The present invention provides a control system for a washing appliance of the type employing high watt density heating means for heating liquid in the wash chamber for improved washing and drying. The control circuit integrates a liquid level sensing means for positive fill control and heater protection with a sequence control means, to prevent damage to the heater in the event of a malfunction of the level sensing means of the type which causes the level sensing means to indicate a full liquid level regardless of the actual liquid level in the wash chamber. Normally, the liquid level sensing means switches from a reset state to a full state when the liquid level sensed in the wash chamber increases to a level equal to or greater than a predetermined full level and switches back to its reset state when the liquid level recedes to a predetermined level less than the full level. The control system includes reset test means for detecting the state of the liquid level sensing means at the end of a drain cycle. The reset test means is operative to prevent the initiation of subsequent operating cycles if the level sensing means is not in its reset state by the end of the drain cycle.

More specifically, the present invention provides a control system for a washing appliance, such as a dishwasher, having a wash chamber for receiving and retaining liquid, fill means for supplying liquid to the wash chamber, drain means for removing liquid from the wash chamber and heater means for heating liquid in the wash chamber. The control system includes sequence control means for controlling the operation of the fill means, drain means, and heater means to provide a plurality of operating cycles including a drain cycle. The control system further includes liquid level sensing means for sensing the quantity of liquid in the wash chamber. Normally, the level sensing means changes from a reset state to a full state when the liquid level detected in the wash chamber equals or exceeds a predetermined full level and returns to its reset state when the detected liquid level recedes to a second predetermined level less than the full level. The level sensing means is operative in its reset state to enable liquid fill and prevent energization of the heater means and in its full state to terminate or prevent liquid fill and enable energization of the heater means. Reset test means for detecting the state of the level sensing means is provided in the control system. The reset test means is operative at the end of a drain cycle to prevent the initiation of subsequent operating cycles by the sequence control means if the level sensing means fails to return to its reset state by the end of a drain cycle.

More specifically, the control system of the present invention includes sequence control means in the form of a timer motor and a plurality of motor-controlled, cam-actuated switches arranged to cyclically energize the fill means, the drain means and the heater means, said switches including a first cam-actuated switch for controlling energization of the timer motor. Level sensing means is provided in the control system in the form of float means positioned to sense and respond to the liquid level in the wash chamber. The float means is operatively connected to a float switch to switch the float switch from a reset position to a full position when the liquid level sensed by the float means equals or exceeds a predetermined fill level and to switch the float switch to its reset position when the liquid level sensed by the float means recedes to a second predetermined level lower than the first level. The float switch is operative in its reset position to enable energization of a solenoid-actuated fill control valve and prevent energization of the heater means, and operative in its full position to prevent energization of the fill control valve and enable energization of the heater means. Reset test means is provided in the form of a second cam-actuated switch which when actuated connects the float switch in an energization controlling relationship with the timer motor. The second cam-actuated switch is arranged for operation in combination with the first cam-actuated switch in a predetermined sequence following termination of the drain cycle. In this sequence, the second switch is actuated and then the first switch is deactuated. If the float switch is in its reset position, the first switch is shunted by the combination of float switch and the actuated second switch and energization of the timer motor is unaffected by the deactuation of the first switch, thereby enabling the motor to initiate subsequent operating cycles uninterrupted. However, if the float switch has not switched to the reset position by the end of the drain cycle, deactuation of the first switch interrupts energization of the timer motor thereby preventing the initiation of subsequent operating cycles.

BRIEF DESCRIPTION OF THE DRAWINGS

While the specification concludes with claims particularly pointing out and distinctly claiming the subject matter which is regarded as the invention, it is believed that the invention will be better understood from the following description of an illustrative embodiment presented with reference to the accompanying drawings in which:

DETAILED DESCRIPTION OF THE INVENTION

Figure 1:
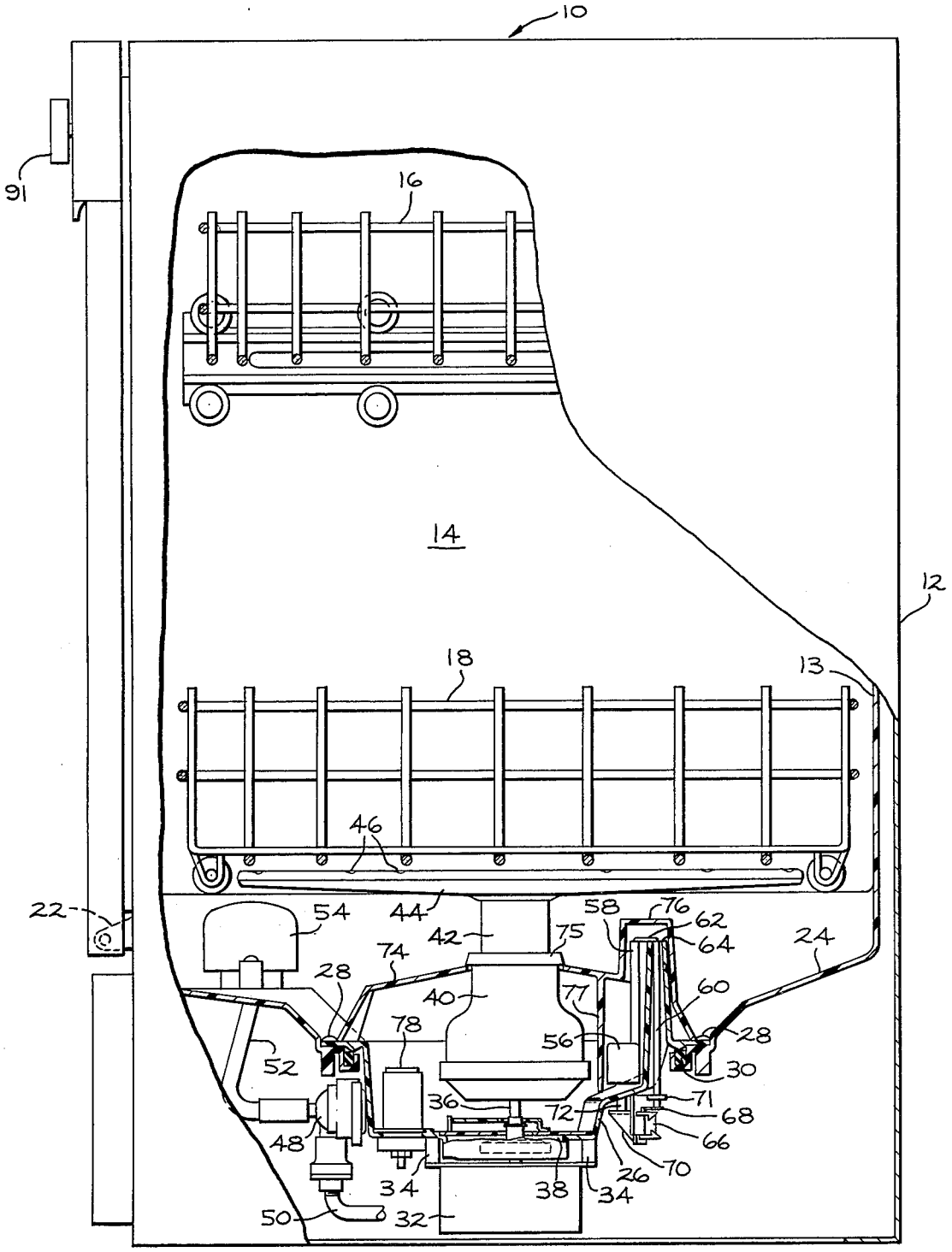
FIG. 1 is a partially cutaway side view of an automatic dishwasher employing one embodiment of the control system of the present invention.

FIG. 1 illustrates a washing appliance which incorporates an exemplary embodiment of the control system of the present invention. The washing appliance of FIG. 1 comprises an automatic dishwasher 10 having an outer cabinet 12 and a tub 13 defining therein a wash chamber 14. Disposed within wash chamber 14 are dish-supporting racks 16 and 18 adapted to receive and support dishes or other articles to be washed within wash chamber 14. A door 20 is provided in one wall of cabinet 12 pivotally mounted by hinge means 22 to provide access to wash chamber 14.

The lower extremity of wash chamber 14 is defined by a bottom wall 24 which slopes toward the center of the dishwasher. A sump 26 is disposed below the low point of bottom wall 24. Sump 26 is secured to bottom wall 24 by fasteners 28. A sealing gasket 30 is provided between bottom wall 24 and sump 26 to prevent leakage.

A pump motor 32 is centrally disposed beneath sump 26 and secured to sump 26 by screws (not shown) received in bosses 34 formed integrally with sump 26. A drive shaft 36 extends upwardly through sump 26 to drive the drain pump impeller (not shown) enclosed within drain pump housing 38 and the main pump impeller (not shown) enclosed within main pump housing 40. Extending upwardly from main pump housing 40 is a pedestal 42 which rotatably supports a reaction-type spray arm device 44. Washing liquid collected in sump 26 is pumped into spray arm 44 by the main pump. Spray arm 44 has a plurality of orifices 46 through which washing liquid is then ejected to effectuate a spray action to distribute washing liquid against articles placed within racks 16 and 18.

The flow of liquid into wash chamber 14 from the ordinary pressurized household water supply is controlled by fill control means in the form of solenoid fill valve 48 which may be any of a number of well known solenoid valve devices readily commercially available. Conduit 50 connects the inlet port of valve 48 to the household water supply.

Flexible hose 52 passes from the outlet port of valve 48 into the interior of wash chamber 14 through a bilevel standpipe (not shown) formed integrally with bottom wall 24. One level of the bilevel standpipe provides a vacuum breaker in the inlet line and the other provides flood level control means. Cover 54 encloses the standpipe and prevents over spray from leaking out of the wash chamber through the standpipe. The liquid entering the wash chamber through hose 52 passes through slotted openings (not shown) in the sides of cover 54 near the bottom wall 24. A more detailed description of the structure and operation of this inlet apparatus is presented in the copending, commonly-assigned U.S. patent application, Ser. No. 046,982, by John G. Crawford et al, entitled "Dishwasher Inlet Air Gap" filed June 8, 1979, incorporated herein by reference.

Positive liquid fill control is provided by liquid level sensing means which, in the illustrative embodiment, takes the form of a mechanical float means 56 which is positioned in the sump to accurately sense the liquid level in the sump. Float means 56 in its preferred form comprises a substantially hollow molded plastic float portion and includes a first stem portion 58 extending upwardly from the float portion and a second stem portion 60 connected to stem portion 58 by a U-shaped connector 62. Connector 62 is employed for manufacturing convenience; however, the float means could readily be formed in one piece having a U-shaped stem portion. A standpipe 64 is formed as circular protrusion integral with and extending upwardly from the bottom of sump 26. Standpipe 64 slidably supports stem portion 60. The interior of standpipe 64 defines an opening extending through the bottom of sump 26. A standard single pole, double throw snap action switch 66 having a leaf actuator 68 is mounted to sump 26 externally thereof by bracket 70 adjacent the opening through the bottom of sump 26 provided by standpipe 64. Stem portion 60 projects externally from sump 26 through the opening provided by standpipe 64 to engage leaf actuator 68. Bracket 70 includes a guide portion 71 having an aperture positioned directly beneath the bottom standpipe opening for slidably receiving that portion of stem portion 60 which projects from sump 26. Leaf actuator 68 extends beneath this aperture for engagement by stem portion 60. Bracket 70 is secured to sump 26 by a screw (not shown) received in integrally molded boss 72.

When the liquid level in the sump is less than a predetermined minimum level, float means 56 is at rest. In the rest position, the weight of the float system causes stem portion 60 to depress upwardly biased actuator leaf 68 sufficiently to actuate switch 66 thereby placing switch 66 in a reset position. As will be explained in greater detail with reference to the control circuit of FIG. 2, switch 66 when in its reset position enables energization of the fill solenoid valve 48. As the liquid level increases such as during a fill operation, float means 56 is raised by the rising liquid. Switch 66 is mounted relative to stem 60 such that when the liquid level rises to a first predetermined level designated a full level, stem 60 releases leaf actuator 68 sufficiently to deactuate switch 66 thereby placing switch 66 in its full position. When in its full position, switch 66 prevents energization of fill valve 48. Thus, switch 66 terminates fill when the liquid level in the wash chamber reaches the full level. During drain cycles as the liquid is removed from the sump area, float means 56 moves downward toward its rest position causing stem portion 60 to gradually depress leaf actuator 68. The regulation characteristic of switch 66 is chosen such that greater depression of the leaf actuator 68 is required to place the switch 66 in its reset position than to retain switch 66 in its reset position. Thus, switch 66 remains in its full position as the sensed liquid level recedes from the full level until the sensed liquid level recedes to a second predetermined level designated the reset level which is lower than the full level. Upon reaching this level, leaf actuator 68 is sufficiently depressed by stem portion 60 to place switch 66 in its reset position. In the illustrative embodiment float means 58 is operative to move switch 66 in its full position when the sensed liquid level rises to the predetermined full level and to move switch 66 to its reset position when the sensed liquid level recedes to the predetermined reset level. This regulation characteristic prevents the switch from responding to slight fluctuations in sensed liquid level as typically occur during wash and rinse cycles in which liquid is being circulated in the wash chamber by the main pump. In the illustrative embodiment, the full liquid level corresponds to approximately 1.5 gallons of liquid in the wash chamber. The reset level is nominally 1.25 gallons.

A molded plastic sump cover 74 having a central opening for receiving pedestal 42 is mounted over main pump housing 40 and held in place by a threaded collar 75 which is threaded onto pedestal 42. Cover 74 includes a raised cylindrical portion 76 which covers standpipe 64 to prevent liquid from leaking out of the wash chamber through standpipe 64. In addition, a wall portion 77 projects downward from the cover to a point near the base of sump 26 leaving sufficient clearance for liquid to pass under the wall portion. This wall provides a sheltered region around the float so that the turbulent liquid flow near the main pump inlet does not disrupt float operation. This enables the float to accurately sense liquid level despite being placed in the sump near the main pump inlet. The details of the float, sump and cover structure and operation are presented in commonly assigned, copending application Ser. No. 970825 filed Dec. 18, 1978 now abandoned, by John G. Crawford, entitled "Mechanically-Operated Level Control for Dishwashers," filed on the same date as the present application and incorporated herein by reference.

In addition to positive fill control using float means 56, timed fill control is also provided as a means of preventing overfill if the float should malfunction in a manner more fully described with reference to FIG. 2.

Heater means for heating the liquid in the wash chamber is provided in the illustrative embodiment in the form of a high watt density (nominally 1000 watt) resistive heater 78 which is enclosed in a cylindrical protective cover mounted to the bottom of sump 26. Because of the relatively high power output of the heater 78, it is undesirable to energize the heater with insufficient liquid in the sump area. As described in greater detail with reference to FIG. 2, float switch 66 enables effective energization of heater 78 when in its full position and prevents effective energization of heater 78 when in its reset position. The full liquid level is selected to insure that heater 78 is only effectively energized when float means 56 senses sufficient liquid to prevent overheating of the heater means. In addition, since heater 78 may remain energized until the liquid level recedes sufficiently to reset switch 66, the reset level should be chosen such that at that level sufficient liquid remains in the wash chamber to prevent overheating.

Thus, during normal operation, the float terminates fill and enables effective heater energization when the liquid level rises to the full level. However, the float may become stuck in its up position corresponding to the full liquid level, as a result of food particles or other foreign objects jamming the float mechanism. In that event, float 56 would be prevented from activating switch 66 when the liquid level recedes such as during a drain cycle. Thus, float switch 66, because of the malfunction of float 56, would simultaneously be preventing the entry of liquid into the wash chamber and enabling energization of the heater. Consequently, means are provided in accordance with the present invention to detect such a malfunction and prevent energization of the heater in such circumstances.

Figure 2:
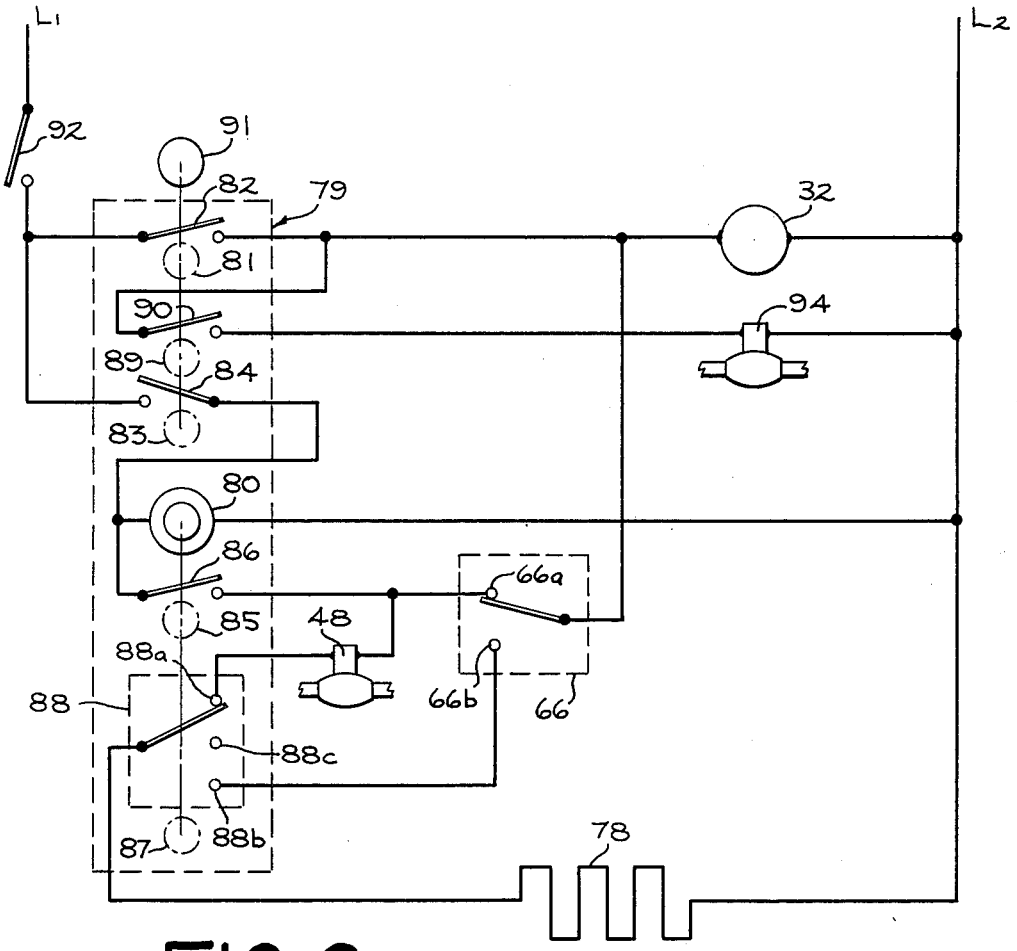
FIG. 2 is a schematic representation of an illustrative embodiment of a control circuit employed in the control system of the present invention.

Referring now to FIG. 2, an illustrative embodiment of the control circuit for the control system of the present invention is shown in schematic form. Power for the control circuit is provided on power lines L1 and L2 which are adapted for connection to a conventional 110 volt 60 Hz AC power supply such as an ordinary household electrical plug-in receptacle. A door switch 92 is serially connected in line L1. Door switch 92 is adapted to be closed as the door latching means (not shown) for door 20 is operated to secure door 20 in its closed position, and to be open when door 20 is not latched closed. Thus, switch 92 serves to de-energize the control circuit whenever door 20 is not secured in its closed position to prevent the escape of wasting liquid from wash chamber 14.

In accordance with the present invention, sequence control means controls the cyclical operation of the various circuit components. In this embodiment, the sequence control means 79 comprises a timer motor 80, a plurality of cams 81, 83, 85, 87 and 89 and respective associated cam-actuated switches 82, 84, 86, 88 and 90 and a manually operable user control knob 91. The cams 81, 83, 85, 87 and 89 and control knob are mounted to a cam shaft driven by timer motor 80. Each of the cam-actuated switches mounted adjacent its associated cam in a manner well known in the appliance control art for sequential actuation of the various switches. Cam-actuated switch 82 connects pump motor 32 across lines L1 and L2. Cam-actuated switch 84 is connected in series with timer motor 80 across lines L1 and L2, thereby controlling energization of timer motor 80 independently of the liquid level in the wash chamber. Cam-actuated switch 86 is connected in series with double throw float switch 66 and timer motor 80 to provide a parallel path for controlling energization of timer 80 which shunts switch 84 when float switch 66 is closed to terminal 66*a* and switch 86 is actuated. Cam-actuated switch 88 is a three position switch which controls energization of the fill valve solenoid 48 and the heater 78; when closed to terminal 88*a*, switch 88 enables energization of the fill solenoid 48 and prevents effective energization of heater 78; when closed to terminal 88*b*, switch 88 enables effective energization of heater 78 and prevents energization of fill solenoid 48; and when closed to terminal 88*c*, switch 88 prevents energization of fill solenoid 48 and heater 78. Cam-actuated switch 90 is connected in series with drain solenoid 94 across lines L1 and L2.

As previously described herein level sensing means for sensing the liquid level in the wash chamber in the illustrative embodiment comprises a snap action switch 66 actuated by a mechanical float means 56 (FIG. 1). As shown in FIG. 2, switch 66 is a single pole, double throw switch having terminals 66*a* and 66*b*, giving switch 66 first and second operative states. Closure to terminal 66*b* defines the first state also designated the full position and closure to terminal 66*a* defines the second or reset state also designated the reset position. Switch 66 is normally biased toward terminal 66*b*. As previously described with reference to FIG. 1, float means 56 is operative to move switch 66 to its full position, closed to terminal 66*b* when the liquid level in the wash chamber sensed by float 56 equals or exceeds a predetermined full level. At this level, the liquid sufficiently raises float means 56 to cause stem portion 60 to release leaf actuator 68 enough to move switch 66 to its full position. When the liquid level sensed by float means 56 is less than the reset level, float means 56 is operative to move switch 66 to its reset state, closed to terminal 66*a* by causing stem portion 60 to sufficiently depress leaf actuator 68.

In accordance with the present invention, reset test means are operatively connected to the level sensing means and the sequence control means and effective upon completion of the drain cycle to prevent continued operation of the sequence control means to provide subsequent operating cycles unless the level sensing means is in its reset state. In the illustrative embodiment the reset test means comprises first and second cam-actuated switches 84 and 86, respectively. Switch 84 serially connects timer motor 80 across power lines L1 and L2. Thus, switch 84 is operative when actuated by timer motor 80 to enable energization of timer motor 80 independent of the liquid level in the wash chamber. Switch 86 is connected in series circuit between the float actuated switch 66 of the level sensing means and timer motor 80. Thus, when actuated by timer motor 80, switch 86 is operative to enable energization of timer motor 80 when switch 66 is in its reset stated closed to terminal 66*a*. When switch 86 is actuated and switch 66 is closed to terminal 66*a*, a current path from L1 to L2 through timer motor 80 is provided which shunts switch 84. Switches 84 and 86 are so connected to the timer motor via cams 83 and 85, respectively, that at the end of a drain cycle timer motor 80 first actuates switch 86, then deactuates switch 84. The timing of the sequential actuation and deactuation of switches 84 and 86 is best seen with reference to the timing diagram of FIG. 3. Thus, at the end of the drain cycle, the opening of switch 84 prevents continued energization of timer motor 80 unless switch 66 is in its reset position closed to terminal 66*a*.

Viewed another way the present invention provides a control system which includes protective switch means in the form of float switch 66, and cam-actuated switch 86 operatively connected in series with timer motor 80 for controlling energization of the timer motor as a function of the liquid level sensed by float means 56. When switch 84, which controls energization of timer motor 80 independent of liquid level, is deactuated, and switch 86 is actuated, float switch 66, which is serially connected to motor 80 by switch 86, enables energization of timer motor 80 when the sensed liquid level is less than the predetermined reset level, and switch 66 prevents energization of timer motor 80 when the sensed liquid level equals or exceeds the predetermined full level. Thus, by actuating switch 86 and then deactuating switch 84 at the end of each drain cycle, a malfunction which prevents float switch 66 from resetting is detected. Damage to the heater or tub is prevented when such a malfunction is identified, by interrupting energization of timer motor 80 thereby preventing subsequent cyclical operation of the appliance pending service by the user or a service person.

Positive fill control is provided in the circuit embodiment of FIG. 2 by electrically connecting solenoid fill valve 48 to terminal 66*a* of float switch 66. It will be recalled that switch 66 is moved to its first or full position by float means 56 when the liquid level sensed by the float means rises to a first predetermined level designated the full level and is moved from its first position to its second or reset position by the float means 56 as the sensed liquid level recedes to a second predetermined level less than the first level, designated the reset level. Energization of fill valve solenoid 48 is enabled when float switch 66 is in its reset position and prevented when in its full position. Fill valve solenoid 48 is connected via terminal 88*a* to heater 79. Solenoid 48 is a high impedance device relative to heater 78 and thus when solenoid 48 is serially connected with heater 78 across a power supply the power dissipated by heater 78 is minimal and not effective to significantly heat the liquid in the wash chamber. Thus, the high impedance of solenoid 48 prevents effective energization of heater 78 when operating in the fill mode. Switch 88 is switched by timer motor to terminal 88*a* at the beginning of a fill cycle and is switched to terminal 88*c* after a predetermined period of time has elapsed, thereby providing redundant fill control. The predetermined period of time is sufficient to allow the liquid level to reach a predetermined level above full to allow the float to control fill under normal operation. The timed fill provides a backup level control to protect against flooding in the event of a malfunction of the float means.

Heating of the washing liquid during various operating cycles is controlled by cam-actuated switches 82 and 88 together with float switch 66. Terminal 66*b* of float switch 66 is connected to heater 78 through terminal 88*b* of switch 88. When float switch 66 is in its full position closed to terminal 66*b* and switch 88 is closed across terminal 88*b*, effective energization of heater 78 is enabled since heater 78 will be directly connected across lines L1 and L2 when switch 82 is closed. When float switch 66 is in its reset position, effective energization of heater 78 is prevented, since only a minimal amount of power is dissipated in the heater 78 when connected in series with fill valve solenoid 94. Thus, even though heater 78 is partially energized in series with fill valve solenoid 48 during fill periods, effective energization of heater 78 is prevented when the liquid level sensed by float means 56 is less than at least the reset level.

A description of the operation of the control circuit of FIG. 2 will now be given as it relates to a complete operational dishwasher 10. First door 20 is secured in its closed position to close switch 92. Then user control knob 91 is manipulated by the user typically by rotation thereof a few degrees to initiate operation of the dishwasher 10 by causing switch 84 to close. Closure of switch 84 connects timer motor 80 across power lines L1 and L2. Shortly, thereafter, timer motor 80 closes switch 82 energizing pump motor 32. After a brief period switch 88 is closed by timer motor 80 to terminal 88*a*, to initiate a pre-wash cycle with a first fill period. It is assumed in the present example that initially only a nominal amount of washing liquid, if any, is present in the wash chamber 14, and that float means 36 is operating normally, causing switch 66 to be in its reset position, closed to terminal 66*a*. Thus, closure of switch 88 to terminal 88*a* energizes fill valve solenoid 48 through float switch 66 and switch 88. As previously described herein, the solenoid is a relatively high impedance device and the voltage drop across the heater is insufficient to cause more than minimal power dissipation in the heater. During normal operation when the liquid level rises to the predetermined full level, switch 66 is moved by float means 56 to its full position closed to terminal 66*b*, thereby de-energizing solenoid 48 which closes the fill valve, terminating the fill. In the event float switch 66 is not closed to terminal 66*b* after a predetermined period either due to a float malfunction, insufficient water pressure or some other problem, fill is automatically terminated by switch 88 which is switched by timer motor 80 from terminal 88*a* to terminal 88*c* thereby de-energizing solenoid 48. It should be noted that pump motor 32 is energized throughout the fill period providing a so-called dynamic fill, that is liquid is being circulated by spray arm 44 during the fill. After the washing liquid is circulated in the wash chamber for a predetermined period, the pre-wash cycle ends with a drain cycle, initiated when timer motor 80 actuates switch 90 to energize drain solenoid 94. Drain solenoid 94 when energized opens a drain valve means (not shown) of the type which once opened is held open by the pressure of the liquid being drained, and thus remains open until the liquid is fully pumped out. The drain means includes a drain pump driven by pump motor 32 and a drain conduit (not shown) connected to the household plumbing for removing liquid from the wash chamber. When drain solenoid 94 is energized, the outlet from the drain pump is opened. Once opened by energization of drain solenoid 94, the liquid passing through the outlet into the drain conduit maintains the drain valve open until the liquid is essentially fully removed from the wash chamber. Thus, solenoid 94 need not be energized throughout the drain period but rather only energized long enough to initiate the draining of water by opening the drain valve means. Timer motor 80 after allowing a predetermined time period sufficient to allow full drainage of the wash chamber marks the end of the drain cycle by actuating switch 86. This initiates a check of the float switch 66 to determine whether float switch has properly switched to its reset position. The check is continued by timer motor 80 which then deactuates switch 84 while switch 86 remains actuated. If float switch 66 is closed to 66*a* indicating reset of the float, continued energization of timer motor 80 is enabled by switches 66 and 86 notwithstanding the opening of switch 84 since switch 84 is shunted by actuated switch 86 and float switch 66 in its reset position. After a brief period, timer motor 80 actuates switch 84 and shortly thereafter deactuates switch 86. The duration of the time intervals between actuation of switch 86 and deactuation of switch 84 and between actuation of switch 84 and deactuation of switch 86, each designated as X in FIG. 3 should be at least one second to insure proper operation thereof. Following deactuation of switch 86, timer motor 80 then proceeds to initiate the next operating cycle which is typically a fill cycle. However, if for any reason float switch 66 remains closed to terminal 66*b* at the end of a drain cycle, continued energization of timer motor 80 will be prevented by the deactuation of switch 84. Once interrupted timer motor 80 will remain de-energized until corrective action is taken by the user or a service person. In this way, energization of the heater in subsequent cycles without sufficient liquid in the wash chamber is prevented.

Referring again to FIG. 3, during the next cycle (first wash), after the pre-wash cycle, energization of heater 78 is enabled following the fill period by timer motor 80 which moves switch 88 to terminal 88*b*. Heater 79 is then fully energized if float switch 66 is in its full position, closed to terminal 66*b*. If during fill the liquid level fails to reach the predetermined full level or prior to the drain cycle for some reason drops below the reset level, switch 66 will be in its reset position and energization of heater 78 will be prevented.

Figure 3:
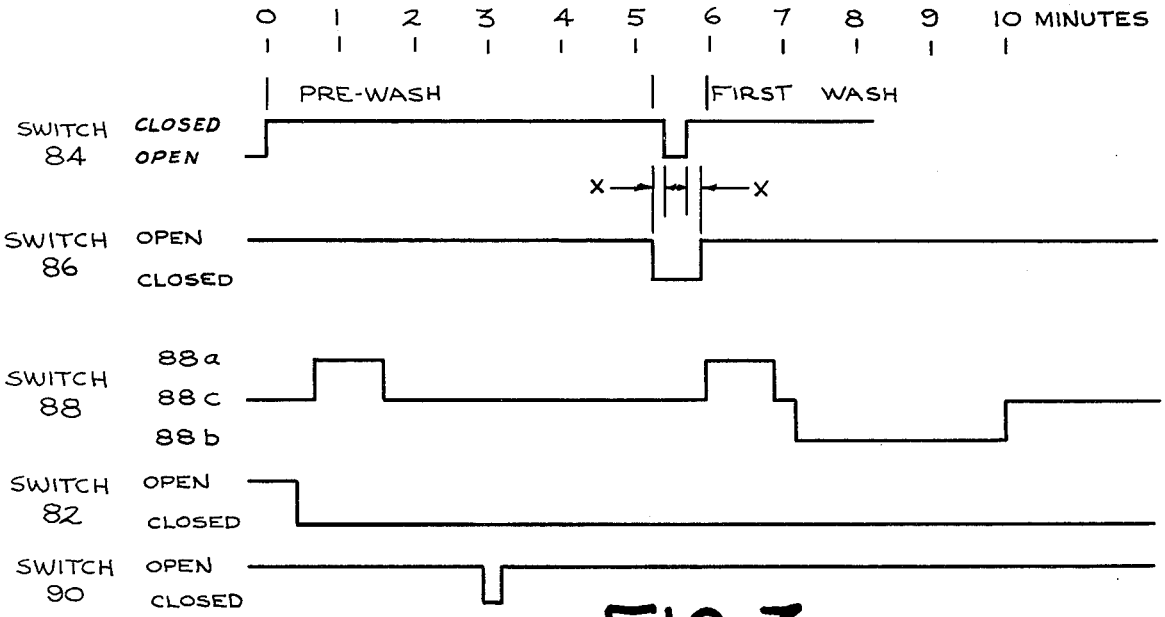
FIG. 3 is a timing chart schematically representing the action of the timer controlled cam-actuated switches in the circuit of FIG. 2 for a part of an operating cycle.

The timing chart of FIG. 3 illustrates only the pre-wash cycle comprising a first fill, circulate and drain and the first wash cycle comprising second fill and circulate cycles during which the washing liquid is heated. In a typical full washing operation there will be several such fill, circulate, and drain cycles for washing and rinsing the dishes. Switches 84 and 86 are arranged to be actuated as described above at the end of each drain cycle throughout the entire full operating cycle of the dishwasher to perform the reset test function.

It should be noted that the control circuit of the present invention need not include a thermostat for controlling water temperature or for providing heater protection resulting in a less complex and consequently more reliable and less expensive circuit. Water temperature is controlled in open loop fashion by controllably energizing the heater for periods of predetermined duration. Heater protection is provided by the level sensing means which prevents full heater energization when the sensed liquid level is below a predetermined level in combination with reset test means which protects against damage as a result of a malfunction of the level sensing means by preventing further cyclic operation of the appliance in the event the sensing means becomes stuck in the full position.

The foregoing is a description of an illustrative embodiment of the invention and it is the inventor's intention in the claims which follow to cover all forms which fall within the spirit and scope of the invention as claimed.

What is claimed is:

1. In a washing appliance having a wash chamber, fill means for controllably supplying liquid to the wash chamber, heater means for heating liquid in the wash chamber, and drain means for controllably removing liquid from the wash chamber; a control system comprising:

level sensing means for sensing the liquid level in the wash chamber, said sensing means being constructed and arranged to assume a reset state when there is less than a predetermined level of liquid in said wash chamber;

sequence control means comprising a timer motor for controlling the fill means and the drain means to provide a plurality of operating cycles including a drain cycle during which liquid is removed from the wash chamber;

a first cam-actuated switch operative, when actuated by said timer motor, to enable energization of said timer motor independent of the liquid level in the wash chamber; and a second, cam-actuated switch connected in circuit between said level sensing means and said timer motor and operative, when actuated by said timer motor, to enable energization of said timer motor when said level sensing means is in its reset state, said first and second cam-actuated switches being so connected to said timer motor that at the end of a drain cycle said timer motor first actuates said second switch and deactuates said first switch, thereby preventing continued energization of said timer motor unless said level sensing means is in its reset state at the end of the drain cycle.

2. A control system in accordance with claim 1 wherein said liquid level sensing means comprises:

float means constructed and arranged to respond to the level of liquid in the wash chamber and a float switch having first and second operative positions; said float means being operatively connected to said float switch for moving said float switch to its first position when the liquid in the wash chamber rises to at least a first predetermined level and for moving said float switch to its second position when the liquid in the wash chamber recedes to a second predetermined level less than said first predetermined level; said second position of said float switch providing the reset state of said level sensing means.

3. A control system in accordance with claim 2 wherein said float switch is connected in controlling relationship to the fill means and the heater means; said float switch being operative in its second position, to enable energization of the fill means and to prevent effective energization of said heater means, and operative in its first position, to enable effective energization of the heater means and to prevent energization of the fill means.

4. In a washing appliance having a wash chamber, fill means for delivering liquid to the wash chamber, heater means for heating liquid and drain means for removing liquid from the wash chamber; a control system comprising:

fill control means operable, when energized, to admit liquid from the fill means into the wash chamber and operable, when de-energized, to prevent liquid from entering the wash chamber;

drain control means operable, upon energization, to initiate the removal of liquid from the wash chamber by the drain means;

float means constructed and arranged to respond to the level of liquid in the wash chamber;

a float switch having a full position and a reset position; said float means being operatively connected to said float switch for moving said float switch to its full position when the liquid in the wash chamber rises to a first predetermined level and for moving said float switch to its reset position when the liquid recedes to a second predetermined liquid level lower than said first predetermined level;

said float switch being operatively connected in controlling relationship to the heater means and said fill control means; said float switch being operative to enable energization of said fill control means and to prevent effective energization of the heater means when in its reset position, and to prevent energization of said fill control means and enable effective energization of said heater means when in its full position;

a timer motor for controlling energization of said fill control means, the heater means and said drain control means to provide a plurality of operating cycles, including a drain cycle during which liquid is removed from the wash chamber;

a first cam-actuated switch operative when actuated by said timer motor to enable energization of said timer motor; and a second cam-actuated switch connected in circuit between said float switch and said timer motor and operative, when actuated by said timer motor, to enable energization of said timer motor when said float switch is in its reset position; said first and second cam-actuated switches being so connected to said timer motor that upon completion of the drain cycle said timer motor first actuates said second switch and then deactuates said first switch, thereby enabling continued energization of said timer motor in response to said float switch being in its reset position and preventing continued energization of said timer motor in response to said float switch being in its full position.

5. In a washing appliance having a wash chamber, fill means for controllably supplying liquid to the wash chamber, heater means for heating liquid in the wash chamber and drain means for controllably removing liquid from the wash chamber; a control system comprising:

float means constructed and arranged to respond to the liquid level in the wash chamber;

a float switch switchable between a full position and a reset position, said float means being operatively connected to said float switch for moving said float switch to its full position when the liquid in the wash chamber is above a first predetermined liquid level and for moving said float switch to its reset position with the liquid level recedes to a second predetermined liquid level lower than said first level; and timer means constructed and arranged for controlling the fill means and the drain means to provide a plurality of operating cycles, including a drain cycle during which liquid is removed from the wash chamber, said timer means including a motor, a first cam-actuated switch for enabling energization of said motor when actuated by said motor, and a second cam-actuated switch coupling said float actuated switch to said motor for enabling energization of said motor when said second switch is actuated by said motor and said float switch is in its reset position, said first and second switch means being so connected to said timer motor that, at the end of said drain cycle, said second switch is actuated and then said first switch is deactuated, enabling continued energization of said timer motor only if said float switch is in its reset position at the end of the drain cycle.

6. A control system in accordance with claim 5 wherein said float switch is connected to the heater means and the fill means and said float switch is operative in its reset position to enable the supplying of liquids to the wash chamber and to prevent effective energization of the heater means and operative in its full position to prevent the supplying of liquid to the wash chamber and to enable effective energization of the heater means.

* * * * *